US005557246A

United States Patent [19]

Ishihara et al.

[11] Patent Number: 5,557,246

[45] Date of Patent: Sep. 17, 1996

[54] HALF WAVELENGH AND QUARTER WAVELENGTH DIELECTRIC RESONATORS COUPLED THROUGH SIDE SURFACES

[75] Inventors: Jinsei Ishihara; Shuuichi Sakai, both of Ishikawa-gun, Japan

[73] Assignee: Murata Manufacturing Co., Ltd., Japan

[21] Appl. No.: 390,331

[22] Filed: Feb. 17, 1995

[30] Foreign Application Priority Data

Feb. 17, 1994 [JP] Japan ..... 6-020310

[51] Int. Cl.[6] ..... H01P 1/202

[52] U.S. Cl. ..... 333/206; 333/222

[58] Field of Search ..... 333/202, 206, 333/222, 223, 224, 225, 226, 204

[56] References Cited

U.S. PATENT DOCUMENTS 4,223,287 9/1980 Nishikawa et al. ..... 333/206

5,130,683 7/1992 Agahi-Kesheh et al. ..... 333/206 X

*Primary Examiner*—Benny Lee

*Assistant Examiner*—Justin P. Bettendorf

*Attorney, Agent, or Firm*—Majestic, Parsons, Siebert & Hsue

[57] ABSTRACT

A compact multi-stage dielectric resonator apparatus is formed by attaching together many dielectric resonators having different resonant frequencies. Each of these dielectric resonators has a dielectric block with a throughhole containing an axially extending inner conductor. The length of the inner conductor for each resonator is either about one-quarter or one-half wavelength of the corresponding resonant frequency. Outer surfaces of the resonators are substantially entirely covered by outer conductors but openings and/or coupling-providing conductors insulated from and entirely surrounded by the outer conductor are provided for magnetically and/or electrostatically coupling the resonators which are attached together. Signal input-output terminals may also be provided separated from and surrounded by the outer conductors for easy mounting of the apparatus on a circuit board.

30 Claims, 14 Drawing Sheets

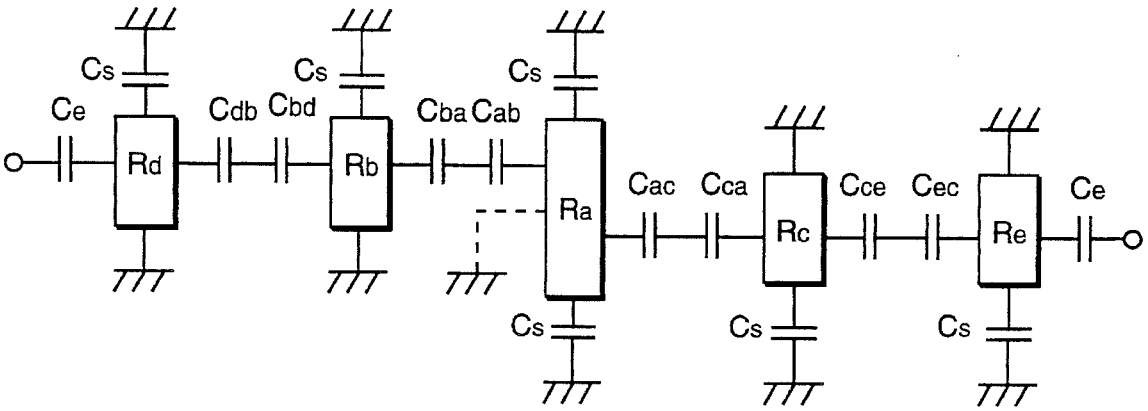
FIG._8
FIG._10
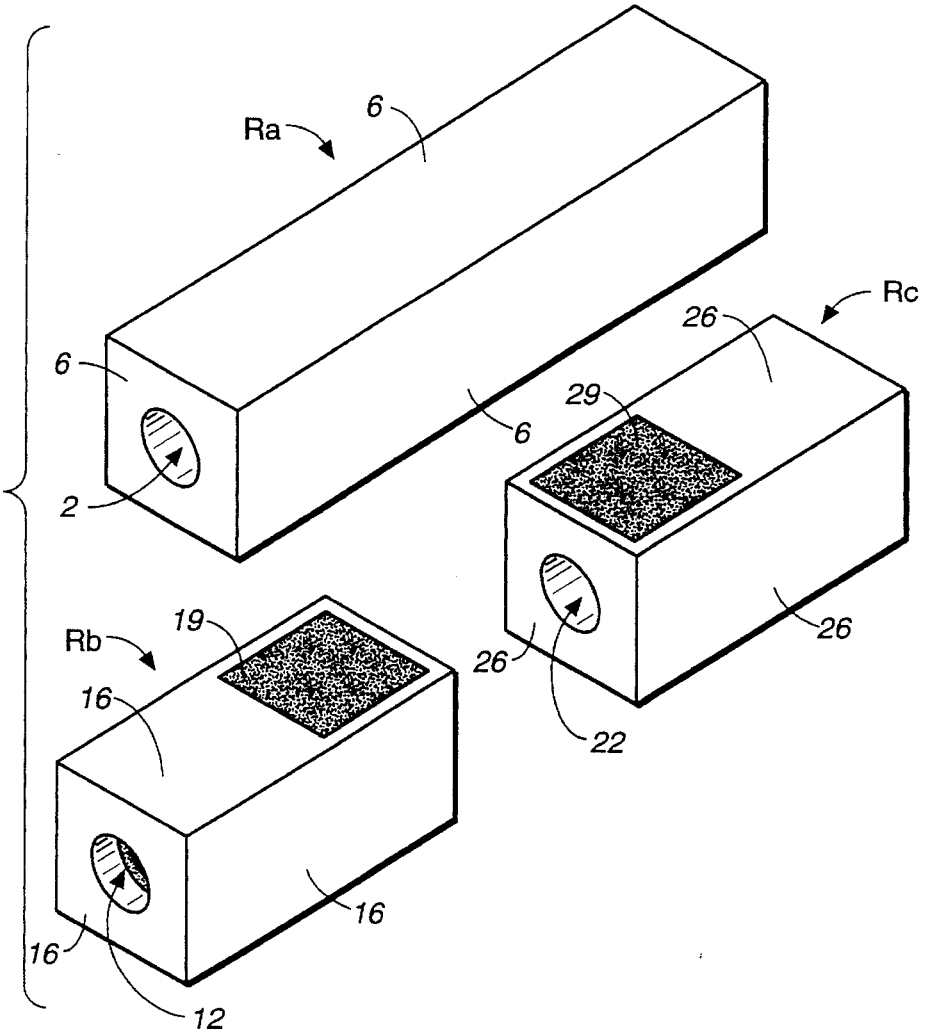

HALF WAVELENGH AND QUARTER WAVELENGTH DIELECTRIC RESONATORS COUPLED THROUGH SIDE SURFACES

BACKGROUND OF THE INVENTION

This invention relates to dielectric resonator apparatus having a plurality of dielectric resonators formed unistructurally.

It has been known, as an example of prior art apparatus of this kind, to provide a plurality of inner conductors inside a dielectric block of a rectangular parallelopiped and an outer conductor on its outer surfaces to thereby produce a dielectric resonator apparatus having a multi-stage resonator. Such unistructurally formed dielectric resonator apparatus are convenient because they do not require a shielding case or brackets for attaching to a circuit board and can be surface-mounted easily.

For producing dielectric resonator apparatus having different numbers of resonators in a dielectric block, however, it was necessary to provide many different kinds of molds. In other words, many molds had to be prepared for producing dielectric resonator apparatus with different characteristics and this affected their production costs adversely. Moreover, since the distances between the resonators are determined by the dimensions and the shapes of the molds, it was difficult to accurately set the degree of coupling between the resonators. In the case of a prior art comblinetype dielectric resonator apparatus, for example, the setting or adjustment of the degree of coupling between the resonators was intimately related to that of the resonant frequencies of the individual resonators such that a change in one would affect the other and hence that it was difficult to set or adjust both of them independently. Since a plurality of mutually parallel inner conductors are arranged inside a single dielectric block, furthermore, the external dimension of the dielectric block will increase in the direction in which these inner conductors are arranged as the number of stages is increased. This reduces the degree of freedom in making connections to connector terminals when it is mounted to a circuit board.

SUMMARY OF THE INVENTION

It is therefore an object of this invention to provide dielectric resonator apparatus with which the problems described above, arising when a plurality of inner conductors are arranged mutually parallel inside a dielectric block, can be solved.

It is another object of this invention to provide dielectric resonator apparatus which do not require a shielding case or mounting brackets.

It is still another object of this invention to provide such dielectric resonator apparatus which can be made compact and manufactured at a lower production cost without providing molds individually for different kinds of resonators.

It is a further object of this invention to provide such dielectric resonator apparatus of which the resonant frequencies of the individual resonators and the degrees of coupling between them can be independently set and adjusted.

It is a still further object of this invention to provide such dielectric resonator apparatus which require only a small area on a circuit board for mounting even if the number of stages of the resonators is increased.

Dielectric resonator apparatus according to this invention, with which the above and other objects can be accomplished, may be characterized broadly as comprising a plurality of dielectric resonators connected together to form a single structure. Each of these dielectric resonators comprises a dielectric block having mutually opposite first and second end surfaces, side surfaces extending between these end surfaces and an axially elongated cavity extending internally between the first and second end surfaces, an inner conductor extending inside the cavity and an outer conductor covering the outer surfaces. In addition, either an opening for providing coupling with the inner conductor or a coupling-providing conductor for providing electrostatic coupling with the inner conductor is formed at least on the side surface together with the outer conductor. Of these dielectric resonators, those having an inner conductor with axial length approximately equal to one-quarter wavelength of the resonant frequency will be hereinafter referred to as dielectric resonators of the first kind, and those having an inner conductor with axial length approximately equal to one-half wavelength of the resonant frequency as dielectric resonators of the second kind. Dielectric resonator apparatus according to this invention are characterized as having dielectric resonators of both the first and second kinds combined and connected together unistructurally. In a dielectric resonator apparatus thus structured, the inner conductors extending inside the elongated cavities serve as resonating conductors. Since the length in the axial direction of a dielectric resonator of the second kind is about twice as large as that of a dielectric resonator of the first kind, dielectric resonators of the first and second kinds, or two dielectric resonators of the first kind, if they are combined together, couple to each other in the direction in which they are arranged, and a dielectric resonator of the second kind is electrically connected between two dielectric resonators of the first kind. Thus, a compact multi-stage dielectric resonator apparatus can be formed according to this invention. Various combinations of different kinds of dielectric resonators are possible within the scope of this invention. If two of the first kind are connected to the same side surface of one of the second kind, for example, a compact apparatus can be built because the axial length of the inner conductor of the resonator of the second kind is approximately twice that of the first kind. More resonators of the first kind may be connected sequentially in two rows on the same side surface of a resonator of the second kind to obtain an apparatus with multiple stages with a reduced overall length as compared to a design wherein single-stage resonators are arranged mutually parallel.

Similarly, different kinds of coupling can be realized within the scope of this invention. For example, both ends of the inner conductor of the resonator of the second kind in the examples described above may be open, each of the open-circuit end portions coupling with an open-circuit end portion of a resonator of the first kind through a coupling-providing conductor, such that a multi-stage apparatus with electrostatically coupled resonators can be obtained. The open-circuit end portions of the inner conductor of such a resonator of the second kind may be made to magnetically couple with open-circuit end portions of resonators of the first kind by providing openings in the outer conductors approximately where the center of the inner conductor is. On the other hand, both ends of the inner conductor of the resonator of the second kind may be shorted to the outer conductor. Each short-circuit end portion of such a resonator of the second kind may be magnetically Coupled to a short-circuit end portion of the inner conductor of a resonator of the first kind through openings provided through the outer conductors. A center portion of the inner conductor of such a resonator of the second kind with two short-circuit ends may be electrostatically coupled with open-circuit end portions of the inner conductors of two resonators of the first kind each through a coupling-providing conductor. In all of these apparatus described above, signal input/output terminals may be formed on side surfaces of resonators of the first or second kind for reducing the area necessary for mounting the apparatus on a circuit board.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIG. 8 is an equivalent circuit diagram of the dielectric resonator apparatus of FIGS. 6 and 7;

FIG. 10 is an exploded diagonal external view of the dielectric resonator apparatus of FIGS. 9A;

Throughout herein, components which are similar or equivalent to each other are indicated by the same symbols for convenience and are not necessarily explained repetitiously, $R_a$ indicating dielectric resonators of the second kind and $R_b$, $R_c$, $R_d$ and $R_e$ indicating dielectric resonators of the first kind, as defined herein, although their structure may be different from one illustrated embodiment of the invention to another.

DETAILED DESCRIPTION OF THE INVENTION

Figure 1A:
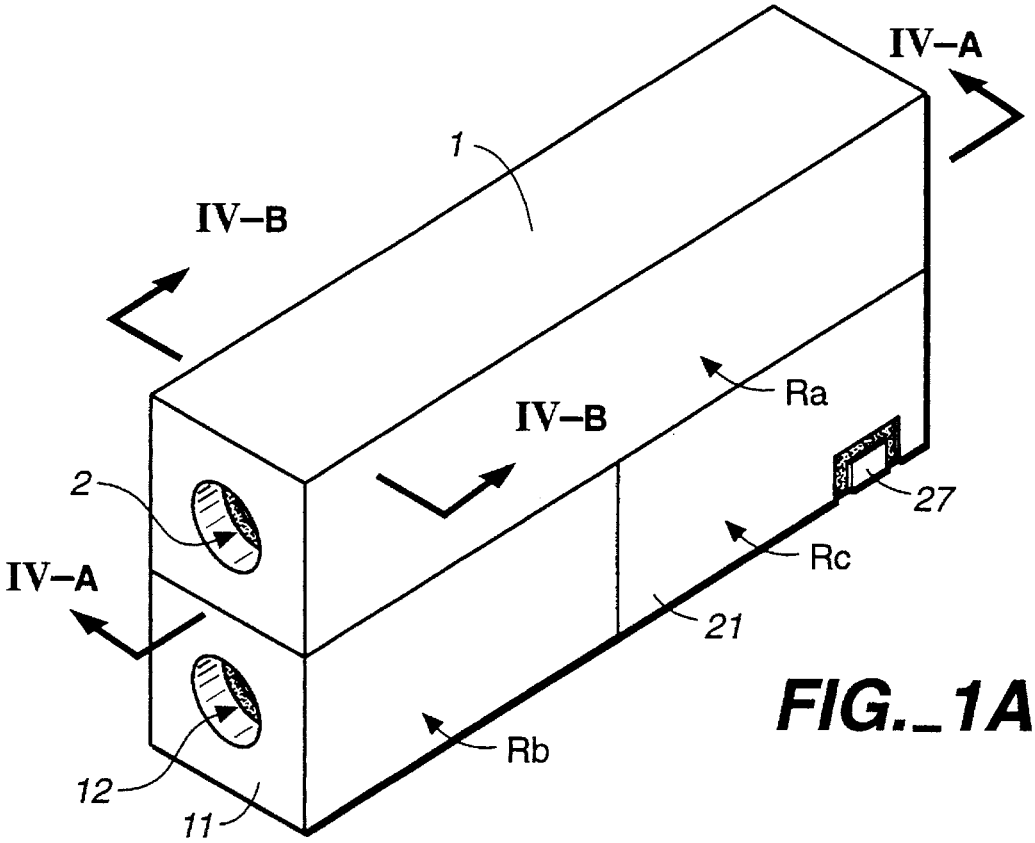
FIG. 1A is an external view of a dielectric resonator apparatus according to a first embodiment of the invention taken diagonally from above.
Figure 1B:
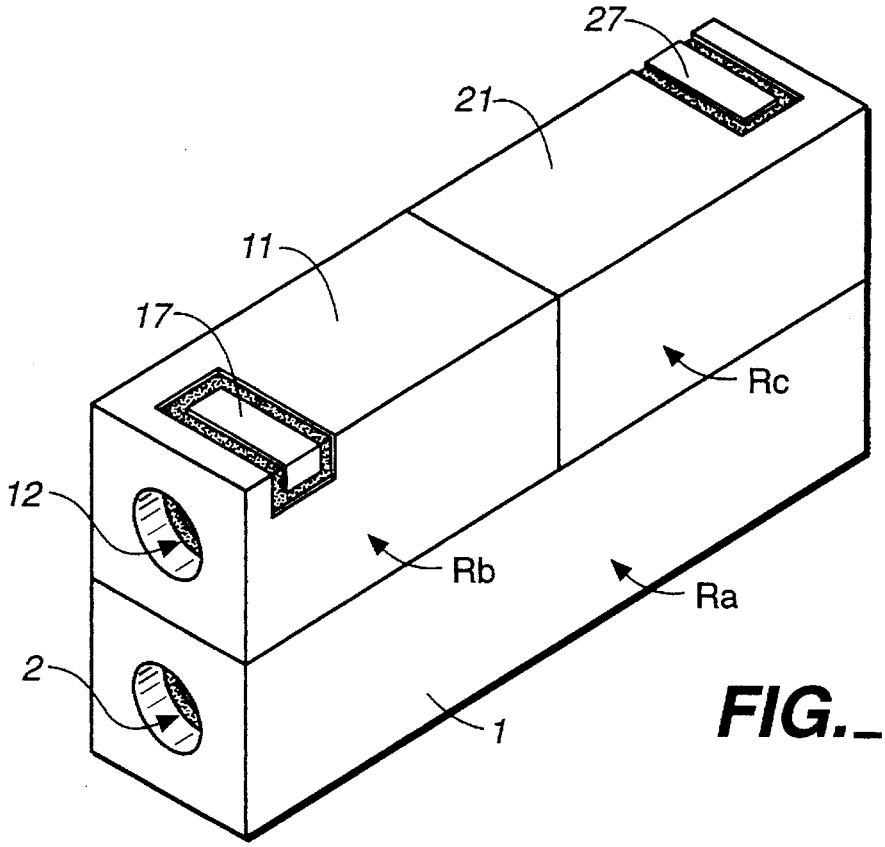
FIG. 1B is another external view of the same dielectric resonator apparatus taken diagonally from below.
Figure 2:
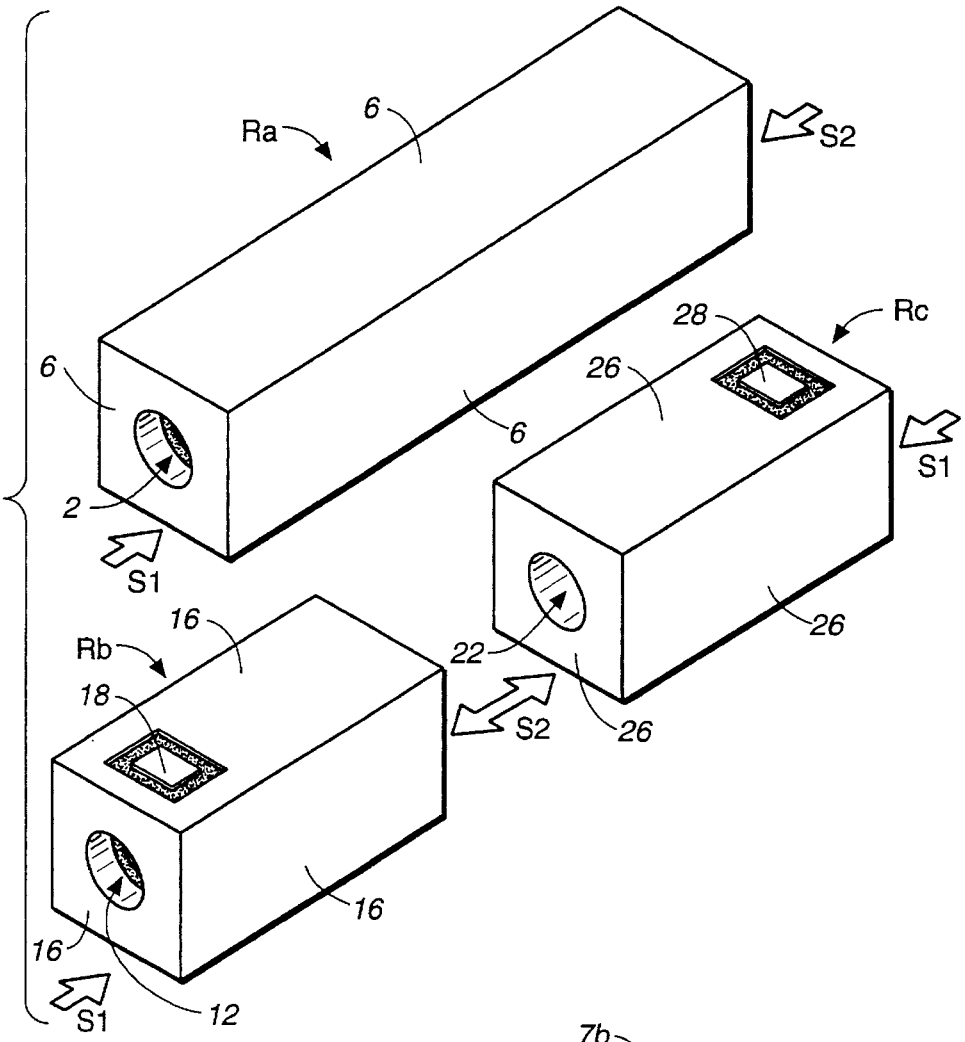
FIG. 2 is an exploded diagonal external view of the dielectric resonator apparatus of FIGS. 1A and 1B.
Figure 3:
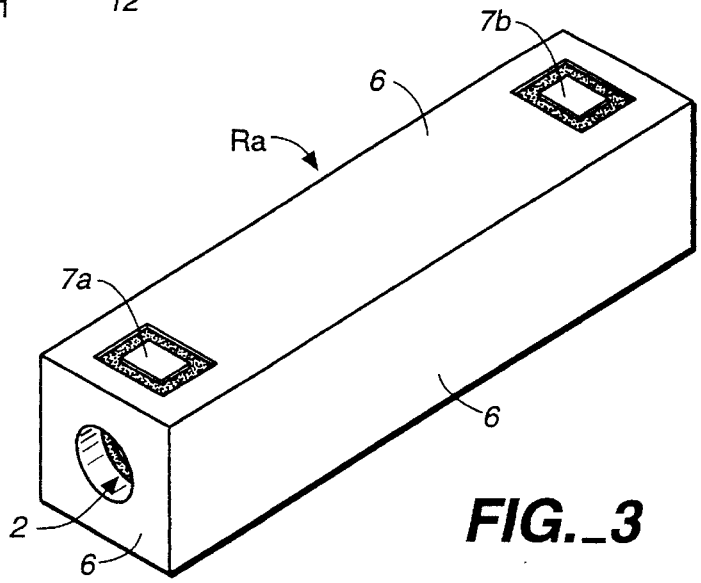
FIG. 3 is diagonal view of the bottom side of the dielectric resonator $R_a$ shown in FIGS. 1 and 2.

FIGS. 1–5 show a dielectric resonator apparatus according to a first embodiment of the invention, characterized as having two dielectric resonators of the first kind $R_b$ and $R_c$ and a dielectric resonator of the second kind $R_a$ joined together to form one unistructural dielectric resonator apparatus. These dielectric resonators $R_a$, $R_b$ and $R_c$ each comprise a dielectric block 1, 11 or 21 of a rectangular parallelopiped having an axially extending throughhole 2, 12 or 22 therethrough. As shown more clearly in FIGS. 2 and 3, the dielectric block 1 for the dielectric resonator of the second kind $R_a$ has two end surfaces (or the first end surface S1 and the second end surface S2) and four side surfaces extending therebetween. Its throughhole 2 extends axially between these two end surfaces S1 and S2, and tubular inner conductors 3, *4a* and *4b* (as shown in FIG. 4A) are formed on the inner surface of this throughhole 2. An outside conductor 6 is provided to substantially entirely cover the four side surfaces and the end surfaces S1 and S2 of the block 1 except, as shown in FIG. 3, that coupling-providing conductors *7a* and *7b* are formed on one of the side surfaces, insulated from and completely surrounded by the outer conductor 6.

Figure 4A:
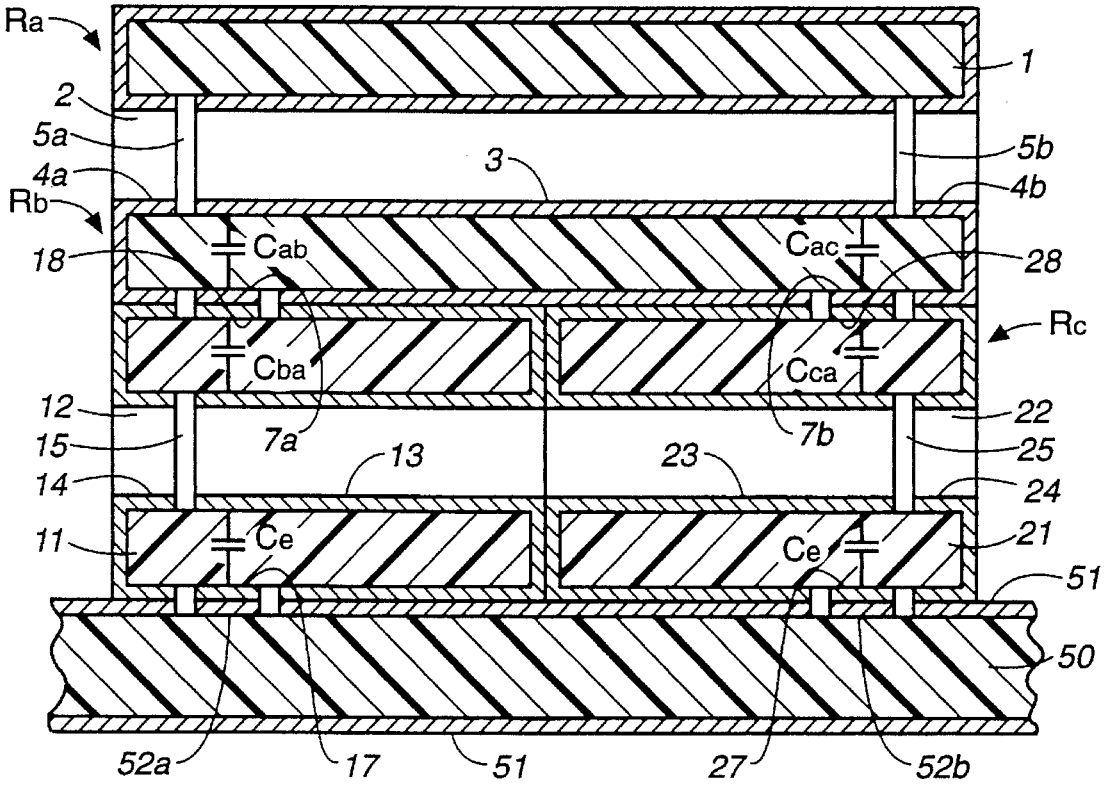
FIGS. 4A and 4B are schematic sectional views of the dielectric resonator apparatus of FIGS. 1 and 2 taken respectively along lines IV-A-IV-A and IV-B-IV-B shown in FIG. 1A.

Similarly, as is shown more clearly in FIG. 4A, each of the dielectric blocks 11 and 12 of the two dielectric resonators $R_b$ and $R_c$ of the first kind has two end surfaces (also referred to for convenience as the first end surface S1 and the second end surface S2) and four side surfaces extending therebetween. Throughholes 12 and 22 extends axially between these two end surfaces S1 and S2, tubular inner conductors 13 and 14 are formed on the inner surface of the throughhole 12 through the block 11 for the dielectric resonator $R_b$, axially separated by an insulating gap 15, and tubular inner conductors 23 and 24 are formed on the inner surface of the throughhole 22 through the block 21 for the dielectric resonator $R_c$, axially separated by an insulating gap 25. Outside conductors 16 and 26 are respectively formed substantially entirely on the four side surfaces and the end surfaces S1 and S2 of the blocks 11 and 21, respectively, except, as shown in FIG. 2, that coupling-providing conductors 18 and 28 are formed on one of the side surfaces of the blocks 11 and 21, respectively, insulated from and completely surrounded by the outer conductors 16 and 26, such that the conductors 18 and 28 respectively connect with the conductors 7*a* and 7*b* when the three dielectric resonators $R_a$, $R_b$ and $R_c$ are joined together, as shown in FIG. 4A. As shown in FIG. 1B, the dielectric resonators of the first kind $R_b$ and $R_c$ are individually provided with signal input/output terminals 17 and 27 insulated from and surrounded by the outer conductors 16 and 26, respectively.

The three inner conductors 3, 4*a* and 4*b* of the dielectric resonator of the second kind $R_a$ are mutually separated by insulating gaps 5*a* and 5*b* as shown in FIG. 4A. The inner conductor 3 with two open-circuit ends is adapted to function as a resonating conductor having axial length approximately equal to one-half of the wavelength corresponding to the resonant frequency. The inner conductors 4*a* and 4*b* are each connected to the outer conductor 6 through the end surface S1 or S2. With the dielectric resonator of the second kind $R_a$ thus structured, stray capacity is generated at the gaps 5*a* and 5*b*, and electrostatic capacities $C_{ab}$ and $C_{ac}$ are generated between portions of the inner conductor 3 near its open-circuit ends abutting the gaps 5*a* and 5*b* and the conductors 7*a* and 7*b*.

The inner conductor 13 for the resonator $R_b$ inside the throughhole 12 is adapted to function as its resonating conductor having axial length approximately equal to one-quarter of the wavelength corresponding to its resonant frequency. The inner conductor 14 is connected to the outer conductor 16 through the first end surface S1 of the dielectric block 11. With the dielectric resonator of the first kind $R_b$ thus structured, stray capacity is generated at the gap 15, electrostatic capacity $C_{ba}$ is generated between portions of the inner conductor 13 near its open-circuit end abutting the gap 15 and the conductor 18, and another electrostatic capacity $C_e$ serving as external coupling capacity between portions of the inner conductor 13 near its open-circuit end and the signal input/output terminal 17. Similarly, the inner conductor 23 for the resonator $R_c$ inside the throughhole 22 is adapted to function as its resonating conductor having axial length approximately equal to one-quarter of the wavelength corresponding to its resonant frequency. The inner conductor 24 is connected to the outer conductor 26 through the first end surface S1 of the dielectric block 21. With the dielectric resonator of the first kind $R_c$ thus structured, stray capacity is generated at the gap 25, electrostatic capacity $C_{ca}$ is generated between portions of the inner conductor 23 near its open-circuit end abutting the gap 25 and the conductor 28, and another electrostatic capacity $C_e$ serving as external coupling capacity between portions of the inner conductor 23 near its open-circuit end and the signal input/output terminal 27. The gaps 5*a*, 5*b*, 15 and 25 can be formed by inserting a rotary grindstone into the throughholes 2, 12 and 22 from the end surfaces of the dielectric blocks 1, 11 and 21 and causing the grindstone to rotate while it is moved axially along the inner surface of each throughhole, thereby removing not only portions of the inner conductors but also portions of the dielectric material of the blocks 1, 11 and 21. The widths, shapes and positions of the gaps 5*a*, 5*b*, 15 and 25 are adjusted so as to control the axial lengths of the inner conductors serving as resonating conductors as well as aforementioned stray capacity. In this manner, the resonant frequency of each resonator as well as the capacity generated between each inner conductor and the coupling-providing conductor or the signal input/output terminal can be adjusted and the degree of coupling between the resonators can be controlled.

Figure 4B:
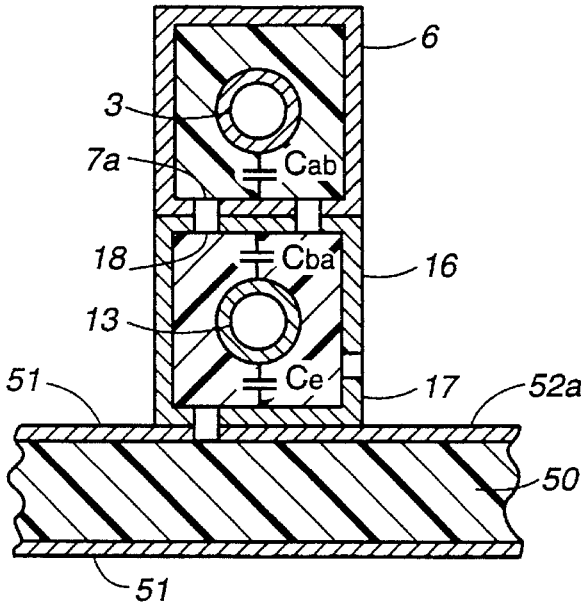

Since each open-circuit end of the inner conductors of the dielectric resonators $R_a$, $R_b$ or $R_c$ is relatively near an external surface of the dielectric resonator apparatus according to this embodiment of the invention, these open-circuit ends can be formed and adjusted easily by the method explained above. Such a dielectric resonator apparatus may be mounted, as shown in FIGS. 4A and 4B, on a circuit board 50 having a signal transmission lines 52*a* and 52*b* and a grounding conductor 51, by connecting the signal input-output terminals 17 and 27 with the signal transmission lines 52*a* and 52*b* and connecting the outer conductor of a dielectric resonator to the grounding conductor 51 on the circuit board 50. When the dielectric resonator apparatus is thus mounted onto a circuit board, the dielectric resonators of the first and second kinds $R_a$, $R_b$ and $R_c$ are connected together and stand up on the circuit board. As a result, the area required for the mounting can be reduced significantly.

Figure 5:
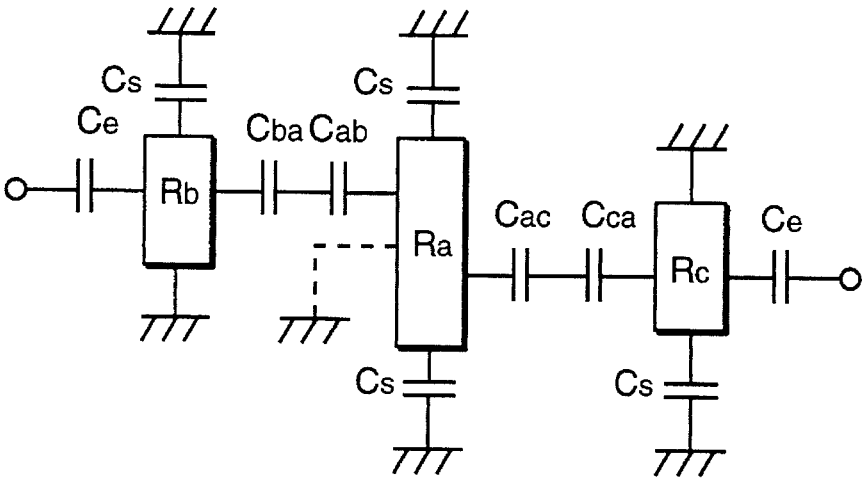
FIG. 5 is an equivalent circuit diagram of the dielectric resonator apparatus of FIG. 1.

FIG. 5 is an equivalent circuit diagram of the dielectric resonator apparatus shown in FIGS. 1–4. In FIG. 5, $C_s$ indicates the stray capacity generated each across the gap 5*a*, 5*b*, 15 or 25. Thus, it can be understood that the dielectric resonator apparatus shown in FIGS. 1–5 can serve, for example, as a three-stage bandpass filter comprising two dielectric resonators each having an inner conductor with axial length approximately equal to a quarter-wavelength of its resonant frequency, and a dielectric resonator having an inner conductor with axial length approximately equal to a half-wavelength of its resonant frequency.

Figure 6A:
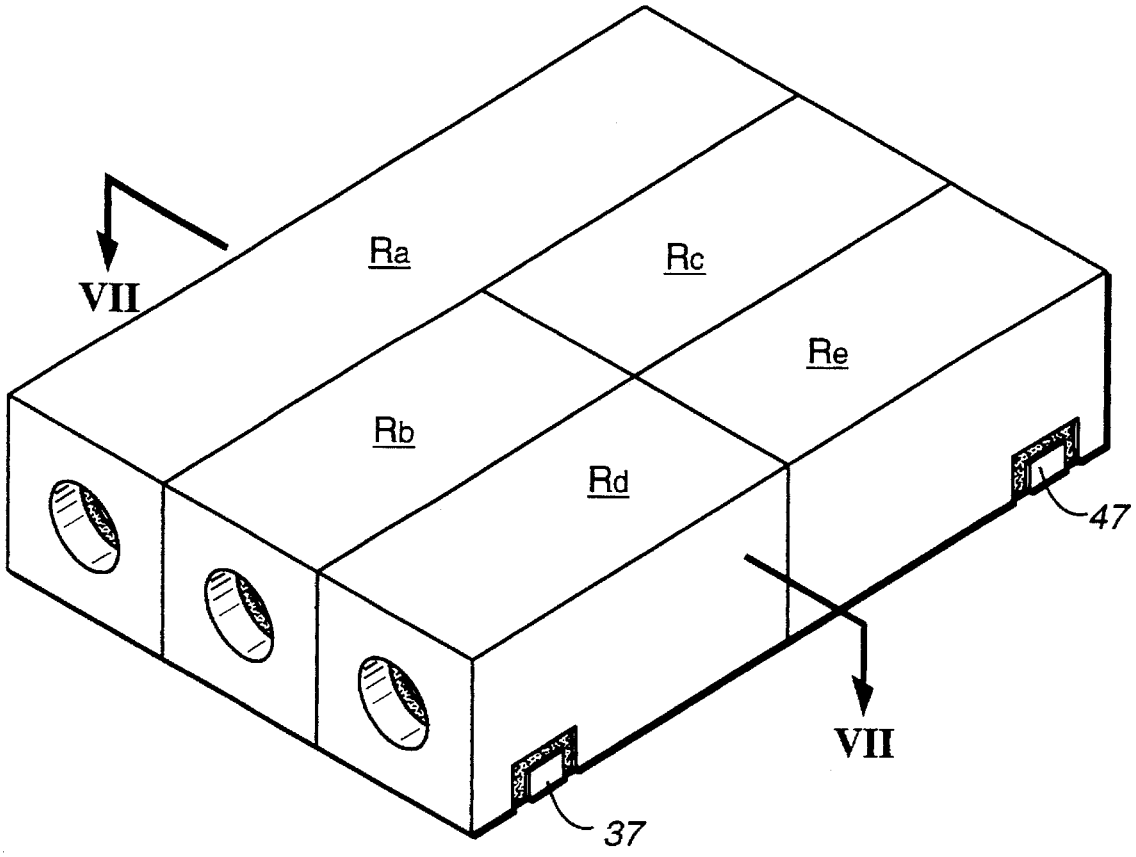
FIG. 6A is an external view of another dielectric resonator apparatus according to a second embodiment of the invention taken diagonally from above.
Figure 6B:
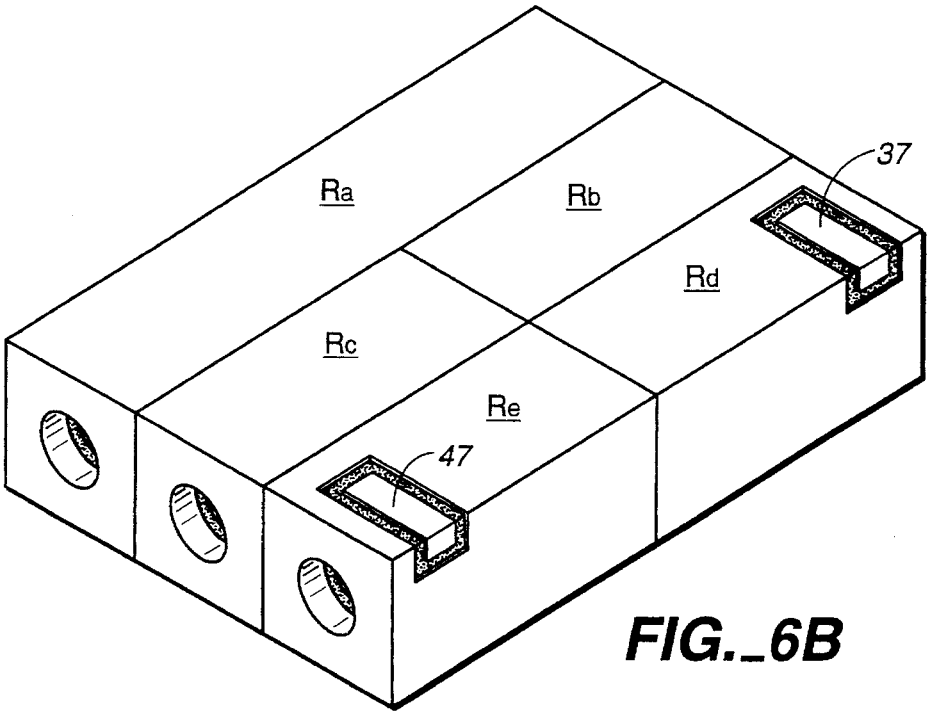
FIG. 6B is another external view of the same dielectric resonator apparatus taken diagonally from below.
Figure 7:
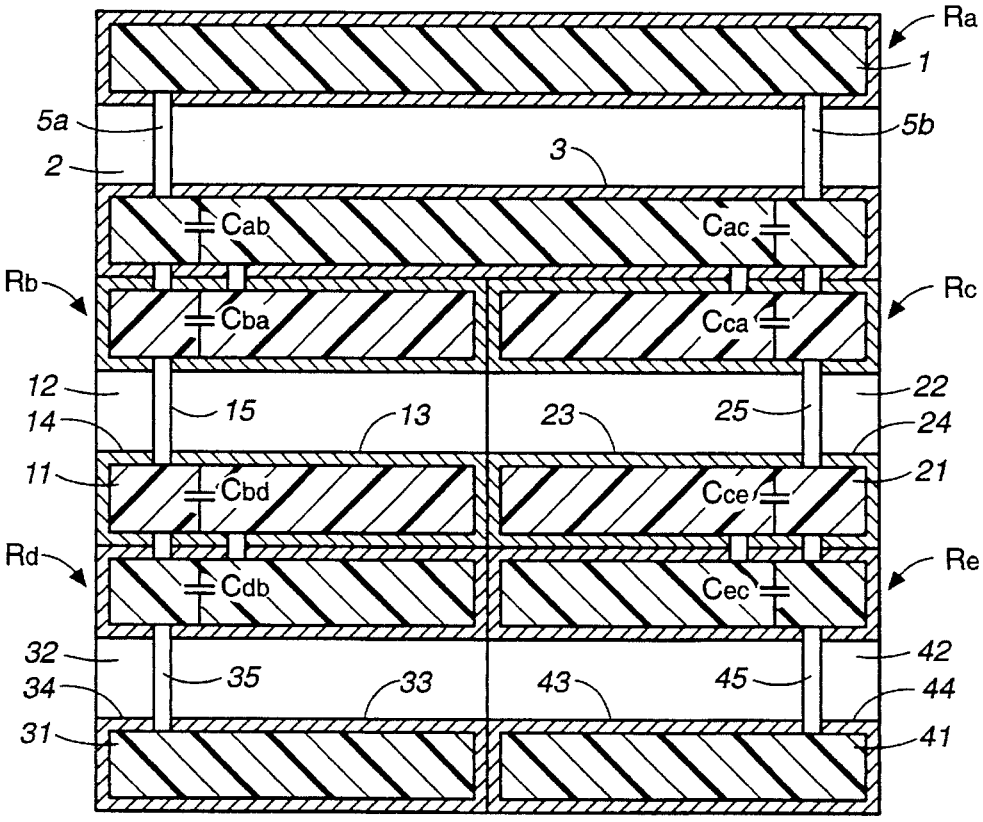
FIG. 7 is a schematic sectional view of the dielectric resonator apparatus of FIGS. 6A and 6B taken along line VII—VII shown in FIG. 6A.

FIGS. 6–8 show another dielectric resonator apparatus according to a second embodiment of the invention comprising four dielectric resonators of the first kind $R_b$, $R_c$, $R_d$ and $R_e$ and one dielectric resonator of the second kind $R_a$ as described above with reference to FIGS. 1–5 for the first embodiment of the invention. They are connected together to form a unistructural apparatus with coupling-providing conductors formed on the planes across which the dielectric resonators $R_b$ and $R_c$ are connected to the dielectric resonator $R_a$ as well as on the planes across which the dielectric resonators $R_b$ and $R_c$ are respectively connected to the dielectric resonators $R_d$ and $R_e$. As shown in FIGS. 6A and 6B, furthermore, signal input/output terminals 37 and 47 are formed on the dielectric resonators $R_d$ and $R_e$, respectively.

More in detail, dielectric blocks 11, 21, 31 and 41, of which the four dielectric resonators of the first kind $R_b$, $R_c$, $R_d$ and $R_e$ are comprised, are respectively formed with a throughhole 12, 22, 32 or 42, each containing therein tubular inner conductors 13 and 14 axially separated by a gap 15, tubular inner conductors 23 and 24 axially separated by a gap 25, tubular inner conductors 33 and 34 axially separated by a gap 35, and tubular inner conductors 43 and 44 axially separated by a gap 45. The inner conductors 13, 23, 33 and 43 are adapted to function as resonating conductors with axial lengths equal to one-quarter wavelengths corresponding respectively to the resonant frequencies of the resonators $R_b$, $R_c$, $R_d$ and $R_e$. In the equivalent circuit diagram shown in FIG. 8 of this dielectric resonator apparatus described above with reference to FIGS. 6 and 7, C, indicates the stray capacity generated at the gaps 5*a*, 5*b*, 15, 25, 35 and 45 in each of the inner conductors, and $C_e$ indicates the external coupling capacity generated between the inner conductors 33 and 43 and the signal input/output terminals 37 and 47. The other electrostatic capacities shown in FIGS. 8 are as indicated in FIG. 7. FIG. 8 shows clearly that the dielectric resonator apparatus shown in FIGS. 6 and 7 serves to function, for example, as a five-stage bandpass filter.

FIGS. 9–12 show a still another dielectric resonator apparatus according to a third embodiment of the invention, which is like the first embodiment described above with reference to FIG. 1 in that the inner conductor 3 of its dielectric resonator of the second kind $R_a$ has two open-circuit ends but is different in that resonator of the second kind $R_a$ is magnetically coupled with the resonators of the first kind $R_b$ and $R_c$ through openings made in their outer conductors.

Figure 9A:
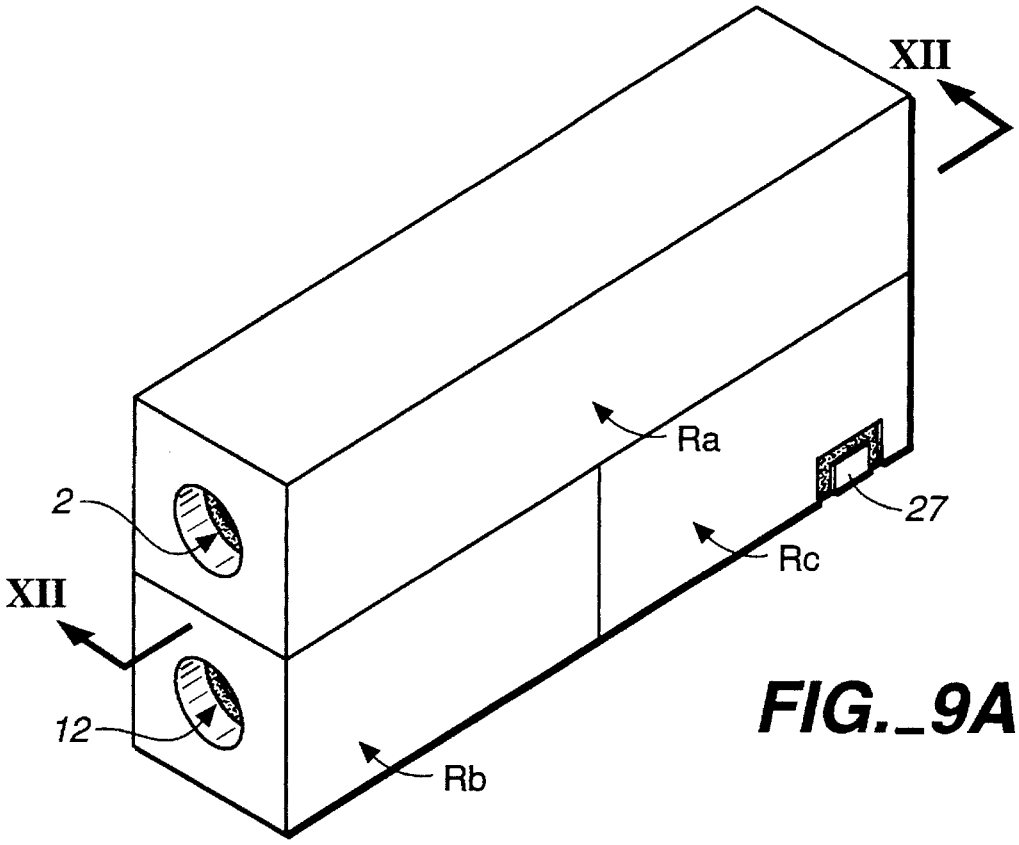
FIG. 9A is an external view of still another dielectric resonator apparatus according to a third embodiment of the invention taken diagonally from above.
Figure 9B:
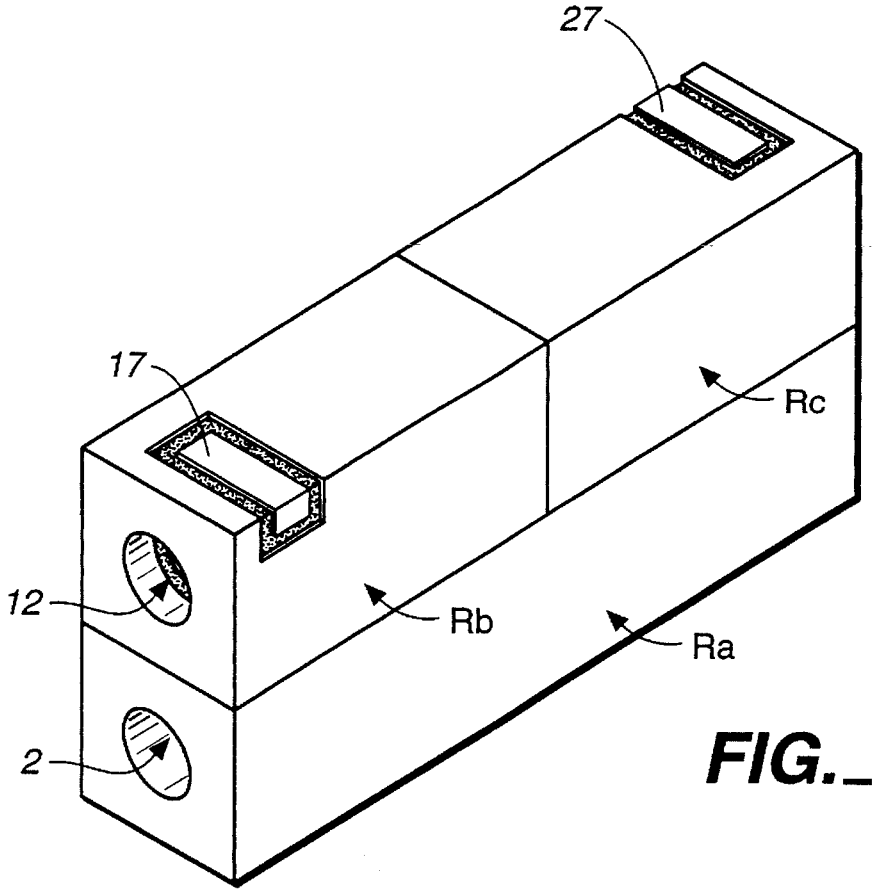
FIG. 9B is another external view of the same dielectric resonator apparatus taken diagonally from below.
Figure 11:
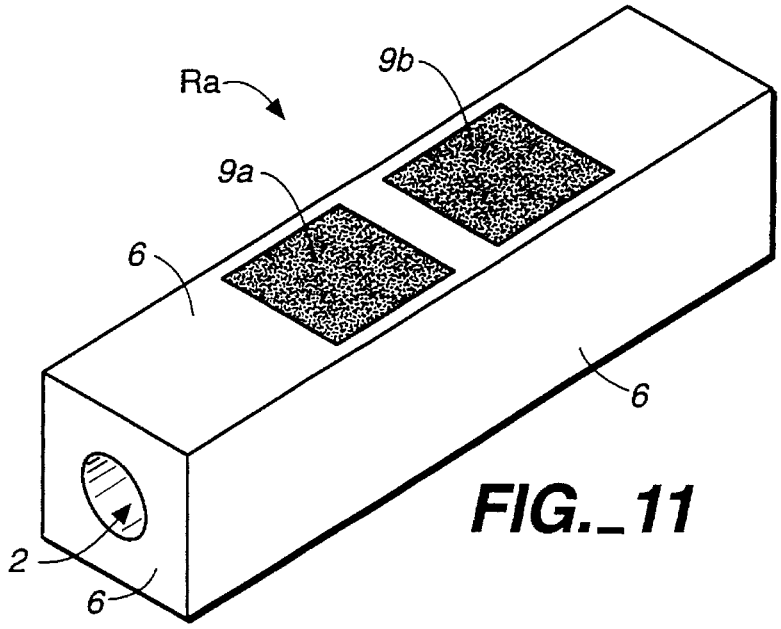
FIG. 11 is a diagonal view of the bottom side of the dielectric resonator $R_a$ shown in FIGS. 9 and 10.
Figure 12:
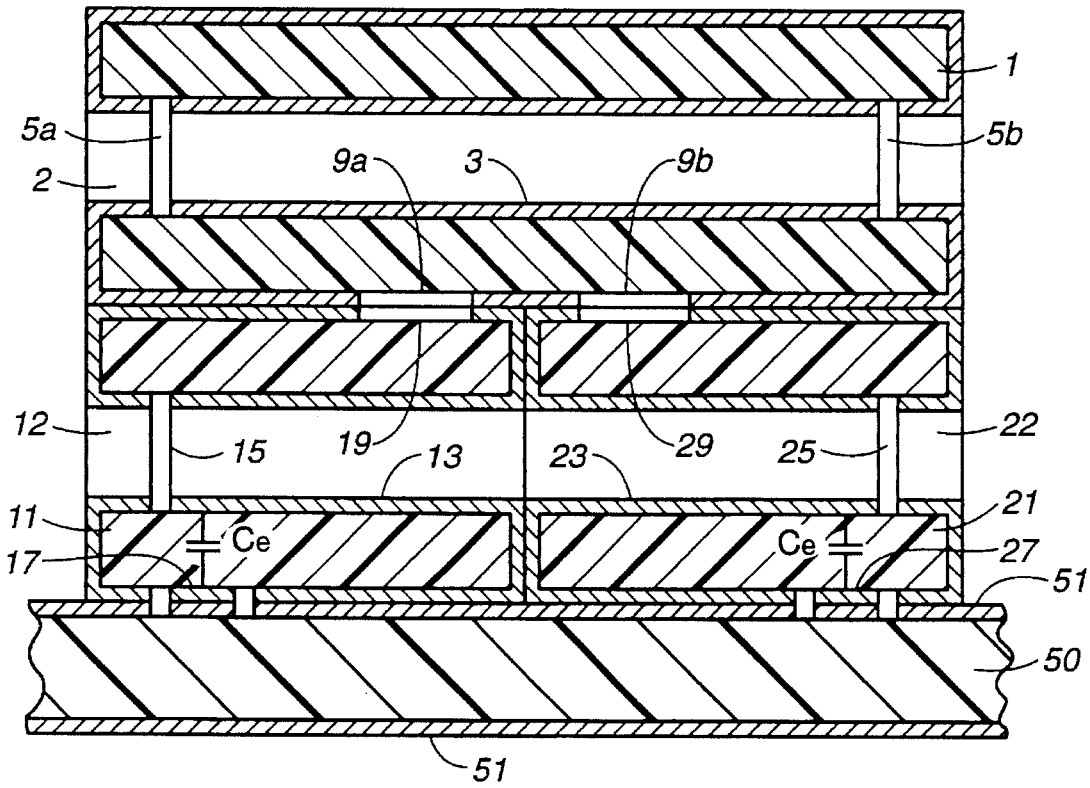
FIG. 12 is a schematic sectional view of the dielectric resonator apparatus of FIG. 9A taken along line XII—XII shown in FIG. 9A.
Figure 13A:
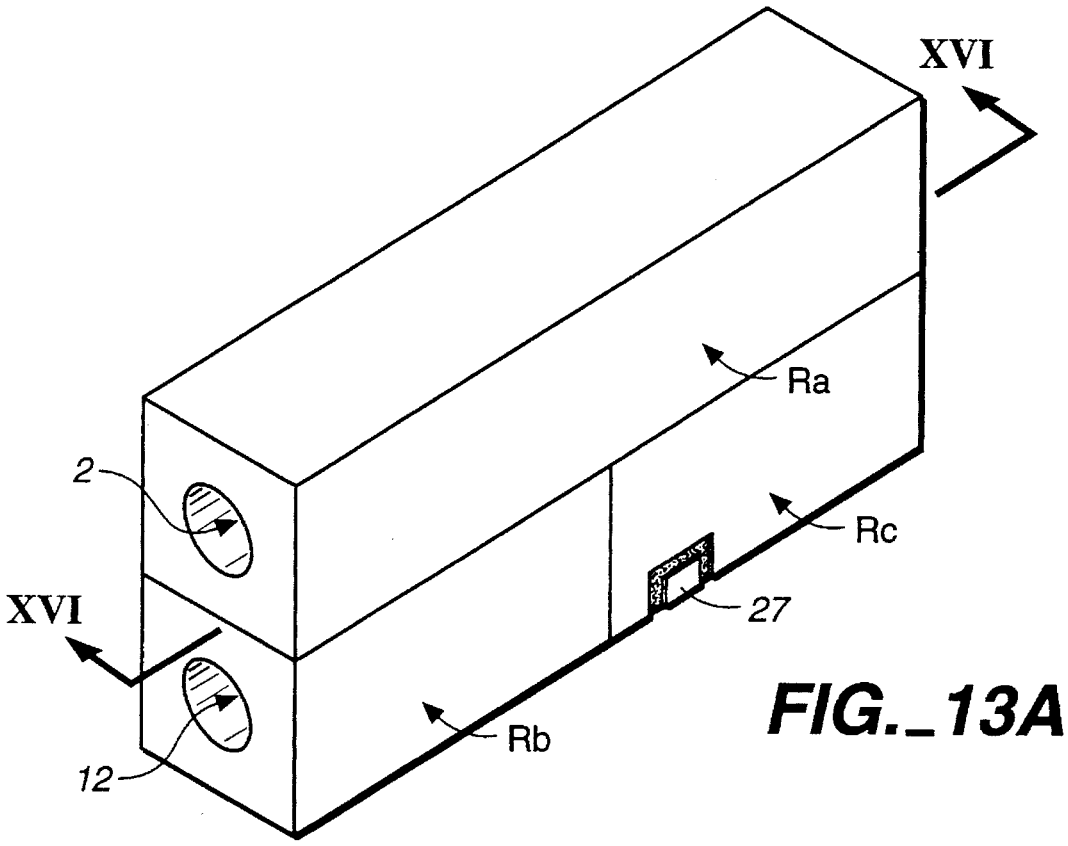
FIG. 13A is an external view of still another dielectric resonator apparatus according to a fourth embodiment of the invention taken diagonally from above.
Figure 13B:
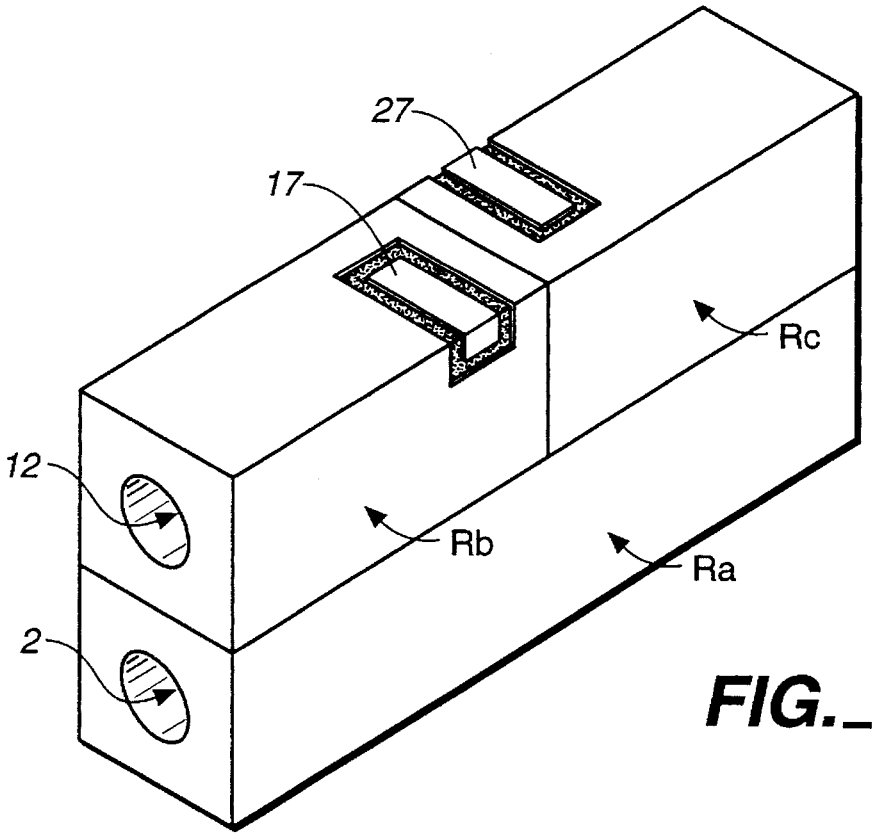
FIG. 13B is another external view of the same dielectric resonator apparatus taken diagonally from below.

More in detail, there are openings 19 and 29 as shown in FIG. 10 in the outer conductors 16 and 26 around the resonators of the first kind $R_b$ and $R_c$ on their top surfaces through which they are attached to the resonator of the second kind $R_a$, and there are corresponding openings *9a* and *9b* as shown in FIG. 11 in the outer conductor 6 around the resonator of the second kind $R_a$ on its bottom surface through which it is attached to the two resonators of the first kind $R_b$ and $R_c$. As the two resonators of the first kind $R_b$ and $R_c$ are attached to the bottom surface of the resonator of the second kind $R_a$ as shown in FIGS. 9A and 12, the corresponding openings are superposed, providing magnetic coupling between the resonators $R_a$ and $R_b$ and between the resonators $R_a$ and $R_c$. As shown in FIG. 9B, signal input/output terminals 17 and 27 are formed at least in part on the bottom surfaces of the two resonators of the first kind $R_b$ and $R_c$. This is similar to the first embodiment of the invention explained above with reference to FIGS. 1–5. As explained with reference to FIG. 4, therefore, there also arise external coupling capacities $C_e$ between open-circuit end portions of the inner conductors 13 and 23 adjacent to their open-circuit ends abutting the gaps 15 and 25 and the signal input-output terminals 17 and 27, respectively.

Figure 14:
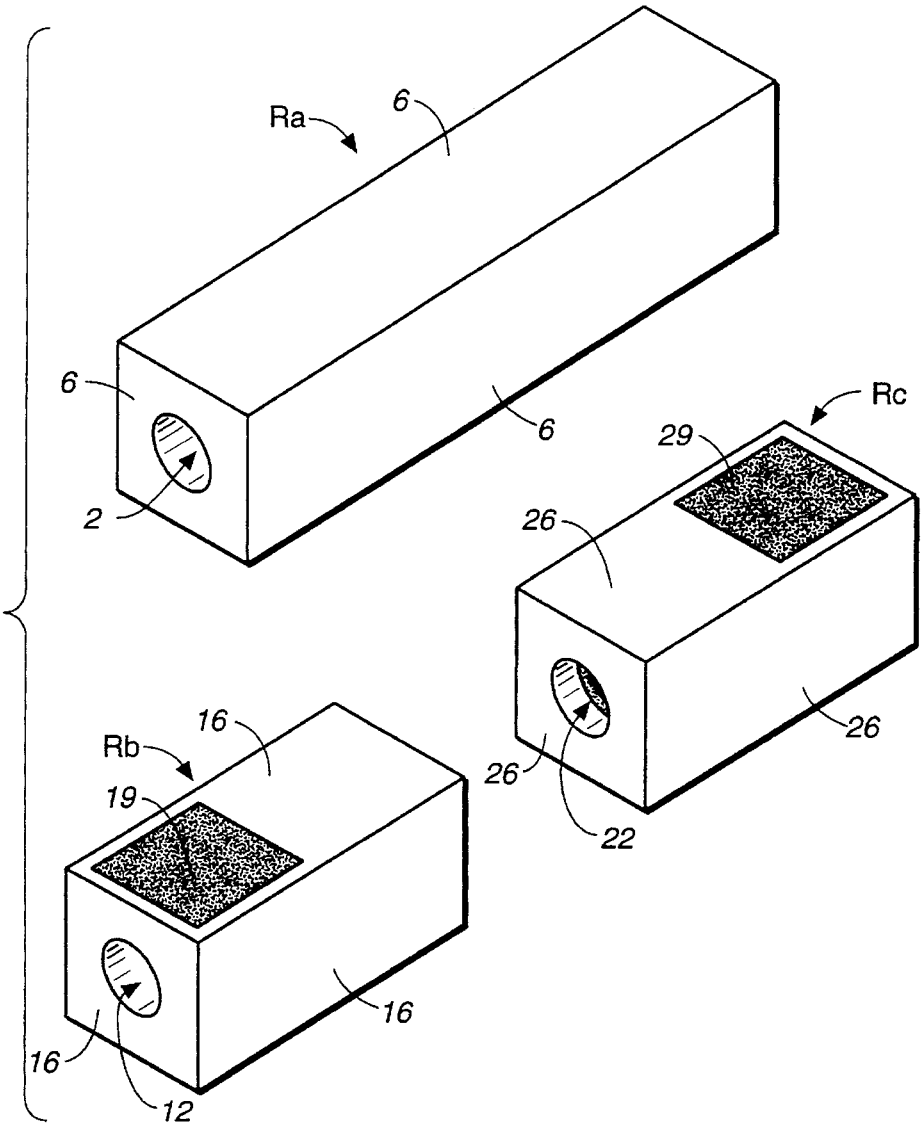
FIG. 14 is an exploded diagonal external view of the dielectric resonator apparatus of FIGS. 13A.
Figure 15:
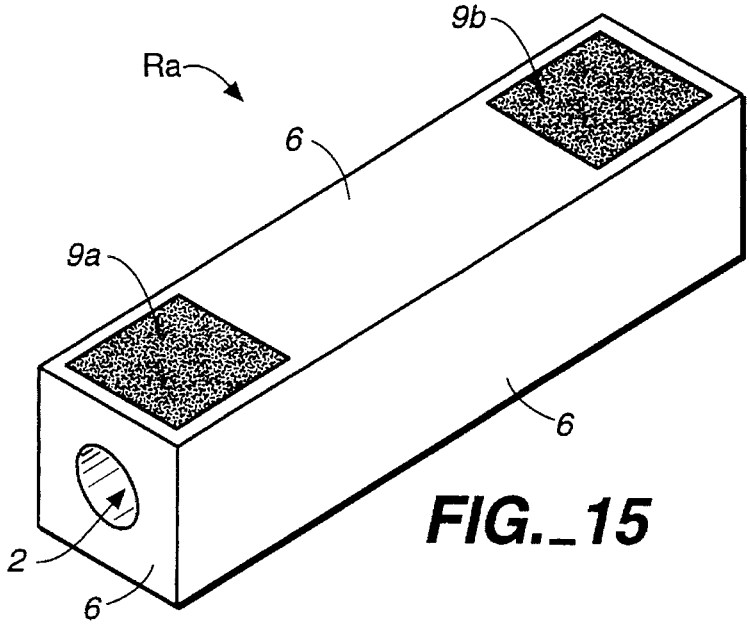
FIG. 15 is a diagonal view of the bottom side of the dielectric resonator $R_a$ shown in FIGS. 13 and 14.
Figure 16:
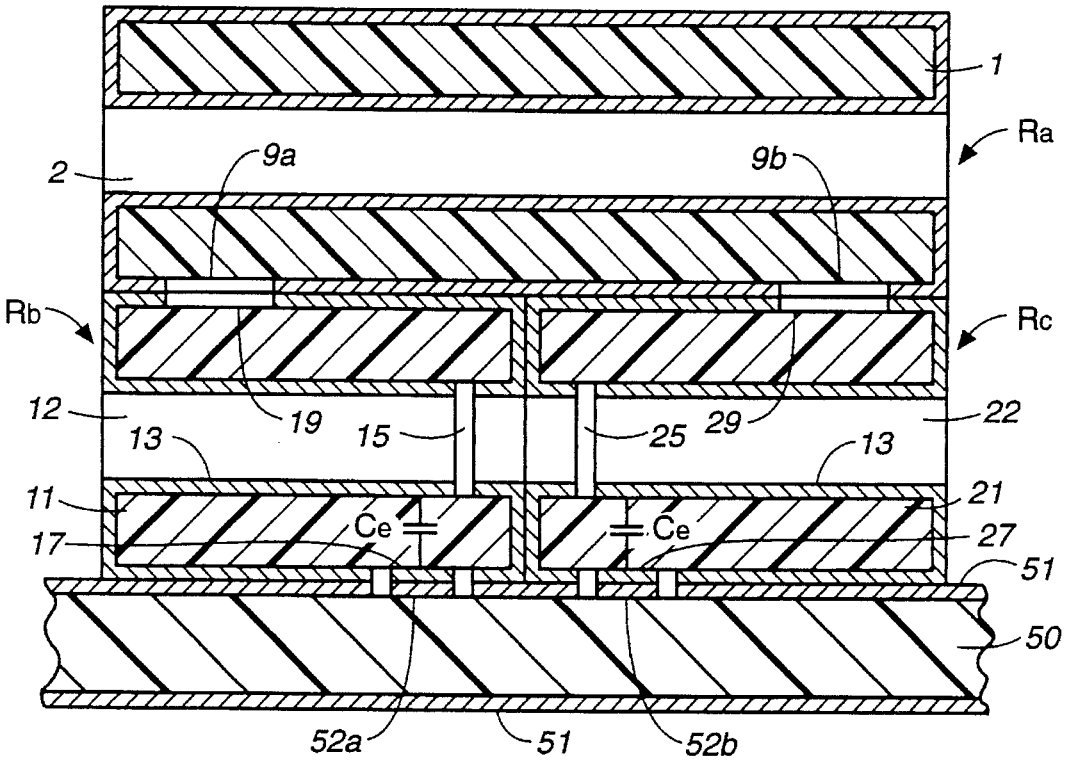
FIG. 16 is a schematic sectional view of the dielectric resonator apparatus of FIG. 13A taken along line XVI—XVI shown in FIG. 13A.

FIGS. 13–16 show still another dielectric resonator apparatus according to a fourth embodiment of this invention, which is similar to the third embodiment explained above with reference to FIGS. 9–12 in that two resonators of the first kind $R_b$ and $R_c$ are attached to the bottom surface of a resonator of the second kind $R_a$ and that both resonators of the first kind $R_b$ and $R_c$ are magnetically coupled with the resonator of the second kind $R_a$ through openings provided in their outer conductors, but is different in that both ends of the inner conductor 2 of the resonator of second kind $R_a$ are shorted to the outer conductor 6. More in detail, there are openings 19 and 29 as shown in FIG. 14 in the outer conductors 16 and 26 around the resonators of the first kind $R_b$ and $R_c$ on their top surfaces through which they are attached to the resonator of the second kind $R_a$, and there are corresponding openings *9a* and *9b* as shown in FIG. 15 in the outer conductor 6 around the resonator of the second kind $R_a$ on its bottom surface through which it is attached to the two resonators of the first kind $R_b$ and $R_c$. As the two resonators of the first kind $R_b$ and $R_c$ are attached to the bottom surface of the resonator of the second kind $R_a$ as shown in FIG. 16, the corresponding openings are superposed, providing magnetic coupling between the resonators $R_a$ and $R_b$ and between the resonators $R_a$ and $R_c$. As shown in FIG. 13B, signal input/output terminals 17 and 27 are formed at least in part on the bottom surface of the two resonators of the first kind $R_b$ and $R_c$. Apparatus according to the fourth embodiment of the invention are advantageous in that there is no open-circuit end of an inner conductor near the outer conductors of the resonators $R_a$, $R_b$ and $R_c$ and hence the leakage of the electromagnetic fields from the opening of the throughholes can be more effectively prevented.

FIGS. 17–20 show still another dielectric resonator apparatus according to a fifth embodiment of the invention, which is similar to the fourth embodiment described above in that both ends of the inner conductor of its dielectric resonator of the second kind $R_a$ are shorted to the outer conductor but is different in that the dielectric resonator of the second kind $R_a$ is electrostatically coupled to the dielectric resonators of the first kind $R_b$ and $R_c$ through coupling-providing conductors.

Figure 17A:
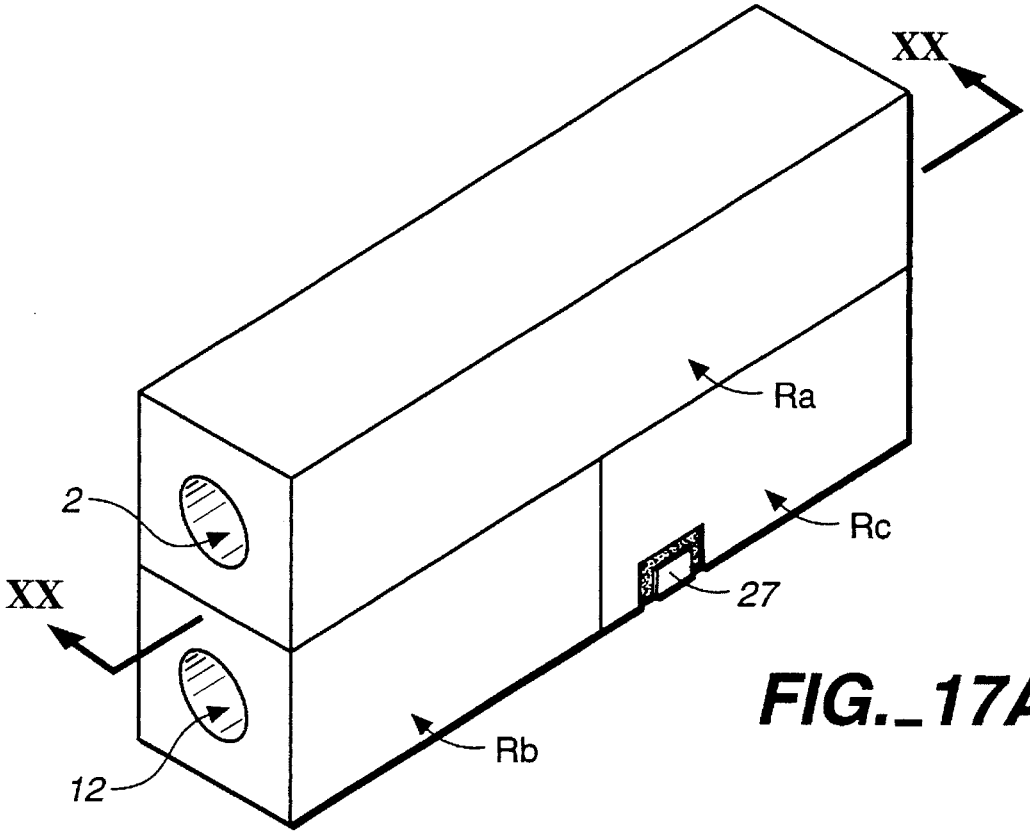
FIG. 17A is an external view of still another dielectric resonator apparatus according to a fifth embodiment of the invention taken diagonally from above.
Figure 17B:
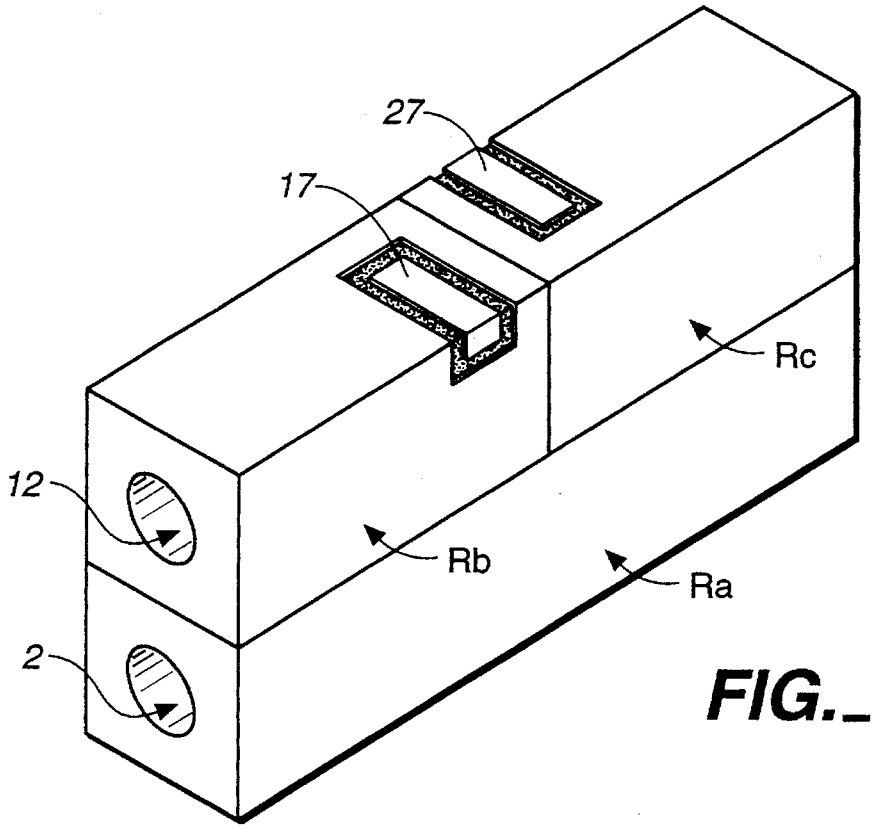
FIG. 17B is another external view of the same dielectric resonator apparatus taken diagonally from below.
Figure 18:
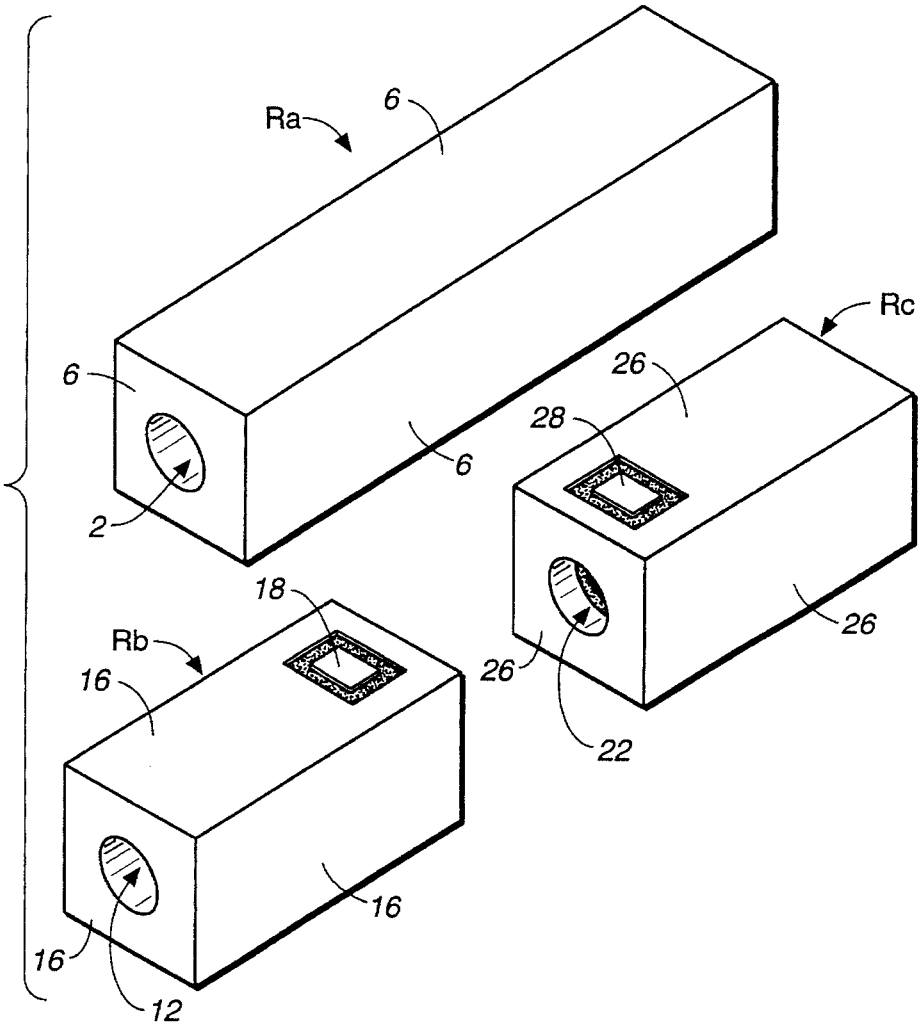
FIG. 18 is an exploded diagonal external view of the dielectric resonator apparatus of FIGS. 17A.
Figure 19:
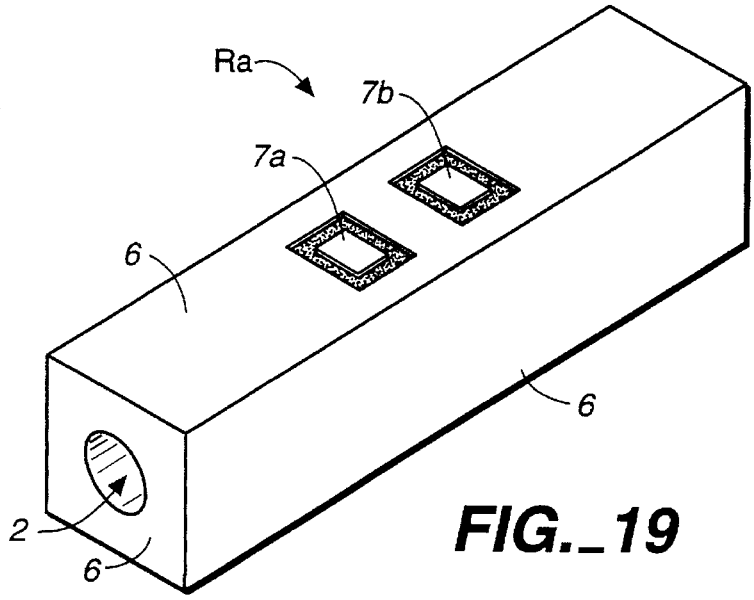
FIG. 19 is a diagonal view of the bottom side of the dielectric resonator $R_a$ shown in FIGS. 17 and 18.
Figure 20:
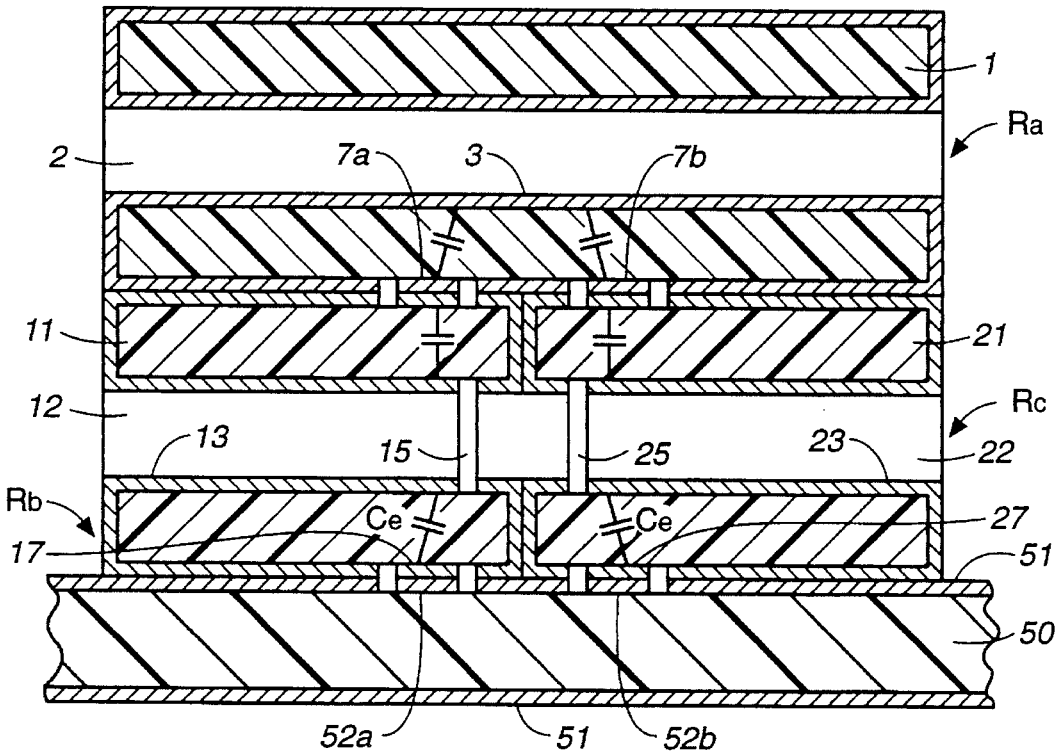
FIG. 20 is a schematic sectional view of the dielectric resonator apparatus of FIG. 17A taken along line XX—XX shown in FIG. 17A.

Explained more in detail, the resonators of the first kind $R_b$ and $R_c$ are provided, as shown in FIG. 18, with coupling-providing conductors 18 and 28 on their upper surfaces through which they are attached to the bottom surface of the resonator of the second kind $R_a$, and similar coupling-providing conductors *7a* and *7b* are provided on the bottom surface of the resonator of the second kind $R_a$, as shown in FIG. 19, so as to be connected with the corresponding coupling-providing conductors 18 and 28 on the resonators of the first kind $R_b$ and $R_c$, as shown in FIGS. 17A and 20. The resonator of the second kind $R_a$ is thus coupled electrostatically with each of the resonators of the first kind $R_b$ and $R_c$ through these coupling-providing conductors *7a*, *7b*, 18 and 28. The resonators of the first kind $R_b$ and $R_c$ are also provided with signal input/output terminals 17 and 27 on their bottom surfaces, respectively.

Although this invention has been described above with reference to only a limited number of examples, these examples are not intended to limit the scope of the invention. It is to be remembered that many modifications and variations are possible within the scope of the invention. For example, dielectric resonators of the first and/or second kind may be attached to different side surfaces of a dielectric resonator of the second kind. As another example, inner conductors need not necessarily be formed on the inner surfaces of throughholes reaching and opening at both end surfaces of a dielectric block. The internal space in which an inner conductor is formed may be a cavity formed inside a dielectric block. In other words, the throughholes described above in all of the illustrated embodiments may be interpreted as special examples of an internal cavity.

Dielectric resonator apparatus according to this invention, as described above by way of examples, are advantageous over prior are apparatus in many respects such as requiring no shielding case or brackets for attachment. Their production cost is low, they are compact and apparatus with different numbers of stages can be manufactured easily without first preparing a large number of molds. Moreover, resonant frequencies and degrees of coupling of the individual resonators can be controlled and/or adjusted easily and independently.

What is claimed is:

1. A dielectric resonator apparatus comprising a plurality of dielectric resonators of a first kind and a dielectric resonator of a second kind attached together to form a unistructural apparatus; each of said dielectric resonators comprising:

a dielectric block having a first end surface and a second end surface which are opposite each other and side surfaces extending between said first and second surfaces, a cavity being formed inside said dielectric block;

an axially elongated inner conductor serving as resonant conductor extending inside said cavity between said first and second end surfaces;

outer conductor formed on said side surfaces; and a coupling area at least on one of said side surfaces, said coupling area comprising a coupling-providing conductor which is insulated from and surrounded by said outer conductor and serves to electrostatically couple with said inner conductor;

the axial length of the inner conductor of each of said dielectric resonators of the first kind being approximately equal to one-quarter wavelength of the resonant frequency of said dielectric resonator of the first kind;

the axial length of the inner conductor of said dielectric resonators of the second kind being approximately equal to one-half wavelength of the resonant frequency of said dielectric resonator of the second kind;

at least one of said dielectric resonators of the first kind, being coupled to at least one of said dielectric resonators of the second kind through side surfaces thereof.

2. The dielectric resonator apparatus of claim 1 wherein two of said dielectric resonators of the first kind are attached to one of the side surfaces of said dielectric resonator of the second kind.

3. The dielectric resonator apparatus of claim 2 wherein said inner conductor of said dielectric resonator of the second kind has two open-circuit end portions axially opposite each other and not connected to any other conductor, said open-circuit end portions coupling through said coupling-providing conductors to open-circuit end portions of the inner conductors of adjacent ones of said dielectric resonators of the first kind.

4. The dielectric resonator apparatus of claim 3 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

5. The dielectric resonator apparatus of claim 2 wherein said inner conductor of said dielectric resonator of the second kind has two ends connected to its outer conductor to form short-circuit end portions adjacent said two end surfaces, two of said dielectric resonators of the first kind attached to said dielectric resonator of the second kind each having a coupling-providing conductor separated from and surrounded by its outer conductor and one end of its inner conductor not connected to its outer conductor to form an open-circuit end portion, a center portion of the inner conductor of said dielectric resonator of the second kind coupling with said open-circuit end portion of the inner conductor of each of said two dielectric resonators of the first kind through its coupling-providing conductor.

6. The dielectric resonator apparatus of claim 5 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

7. The dielectric resonator apparatus of claim 2 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

8. The dielectric resonator apparatus of claim 1 wherein a plurality of said dielectric resonators of the first kind are arranged in two rows and attached sequentially to one of the side surfaces of said dielectric resonator of the second kind.

9. The dielectric resonator apparatus of claim 8 wherein said inner conductor of said dielectric resonator of the second kind has two ends connected to its outer conductor to form short-circuit end portions adjacent said two end surfaces, two of said dielectric resonators of the first kind attached to said dielectric resonator of the second kind each having a coupling-providing conductor separated from and surrounded by its outer conductor and one end of its inner conductor not connected to its outer conductor to form an open-circuit end portion, a center portion of the inner conductor of said dielectric resonator of the second kind coupling with said open-circuit end portion of the inner conductor of each of said two dielectric resonators of the first kind through its coupling-providing conductor.

10. The dielectric resonator apparatus of claim 9 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

11. The dielectric resonator apparatus of claim 8 wherein said inner conductor of said dielectric resonator of the second kind has two open-circuit end portions axially opposite each other and not connected to any other conductor, said open-circuit end portions coupling through said coupling-providing conductors to open-circuit end portions of the inner conductors of adjacent ones of said dielectric resonators of the first kind.

12. The dielectric resonator apparatus of claim 11 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

13. The dielectric resonator apparatus of claim 8 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

14. The dielectric resonator apparatus of claim 1 wherein said inner conductor of said dielectric resonator of the second kind has two ends connected to its outer conductor to form short-circuit end portions adjacent said two end surfaces, two of said dielectric resonators of the first kind attached to said dielectric resonator of the second kind each having a coupling-providing conductor separated from and surrounded by its outer conductor and one end of its inner conductor not connected to its outer conductor to form an open-circuit end portion, a center portion of the inner conductor of said dielectric resonator of the second kind coupling with said open-circuit end portion of the inner conductor of each of said two dielectric resonators of the first kind through its coupling-providing conductor.

15. The dielectric resonator apparatus of claim 14 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

16. The dielectric resonator apparatus of claim 1 wherein said inner conductor of said dielectric resonator of the second kind has two open-circuit end portions axially opposite each other and not connected to any other conductor, said open-circuit end portions coupling through said coupling-providing conductors to open-circuit end portions of the inner conductors of adjacent ones of said dielectric resonators of the first kind.

17. The dielectric resonator apparatus of claim 16 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

18. The dielectric resonator apparatus of claim 1 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

19. A dielectric resonator apparatus comprising a plurality of dielectric resonators of a first kind and a dielectric resonator of a second kind attached together to form a unistructural apparatus; each of said dielectric resonators comprising:

a dielectric block having a first end surface and a second end surface which are opposite each other and side surfaces extending between said first and second surfaces, a cavity being formed inside said dielectric block;

an axially elongated inner conductor serving as resonant conductor extending inside said cavity between said first and second end surfaces;

outer conductor formed on said side surfaces; and a coupling area at least on one of said side surfaces, said coupling area serving as a magnetically coupling area having said outer conductor formed therein with an opening for producing magnetic coupling to said inner conductor;

the axial length of the inner conductor of each of said dielectric resonators of the first kind being approximately equal to one-quarter wavelength of the resonant frequency of said dielectric resonator of the first kind;

the axial length of the inner conductor of said dielectric resonators of the second kind being approximately equal to one-half wavelength of the resonant frequency of said dielectric resonator of the second kind;

at least one of said dielectric resonators of the first kind, being magnetically coupled to at least one of said dielectric resonators of the second kind through side surfaces thereof.

20. The dielectric resonator apparatus of claim 19 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

21. The dielectric resonator apparatus of claim 19 wherein said inner conductor of said dielectric resonator of the second kind has two open-circuit end portions not connected to any other conductor, two of said dielectric resonators of the first kind which are attached to said dielectric resonator of the second kind each having an opening through its outer conductor and one end of its inner conductor connected to its outer conductor to form a short-circuit end, a center portion of the inner conductor of said dielectric resonator of the second kind magnetically coupling with a short-circuit end portion near the short-circuit end of the inner conductor of each of said two dielectric resonator of the first kind through said opening thereof.

22. The dielectric resonator apparatus of claim 21 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

23. The dielectric resonator apparatus of claim 19 wherein said inner conductor of said dielectric resonator of the second kind has two ends connected to its outer conductor to form short-circuit end portions adjacent said two end surfaces, two of said dielectric resonators of the first kind attached to said dielectric resonator of the second kind each having an opening through its outer conductor and one end of its inner conductor connected to its outer conductor to form a short-circuit end portion, said short-circuit end portions of the inner conductor of said dielectric resonator of the second kind each magnetically coupling with the short-circuit end portion of the inner conductor of one of said two dielectric resonators of the first kind through the opening thereof.

24. The dielectric resonator apparatus of claim 23 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

25. The dielectric resonator apparatus of claim 19 wherein two of said dielectric resonators of the first kind are attached to one of the side surfaces of said dielectric resonator of the second kind.

26. The dielectric resonator apparatus of claim 25 wherein said inner conductor of said dielectric resonator of the second kind has two open-circuit end portions not connected to any other conductor, two of said dielectric resonators of the first kind which are attached to said dielectric resonator of the second kind each having an opening through its outer conductor and one end of its inner conductor connected to its outer conductor to form a short-circuit end, a center portion of the inner conductor of said dielectric resonator of the second kind magnetically coupling with a short-circuit end portion near the short-circuit end of the inner conductor of each of said two dielectric resonator of the first kind through said opening thereof.

27. The dielectric resonator apparatus of claim 26 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

28. The dielectric resonator apparatus of claim 5 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

29. The dielectric resonator apparatus of claim 25 wherein said inner conductor of said dielectric resonator of the second kind has two ends connected to its outer conductor to form short-circuit end portions adjacent said two end surfaces, two of said dielectric resonators of the first kind attached to said dielectric resonator of the second kind each having an opening through its outer conductor and one end of its inner conductor connected to its outer conductor to form a short-circuit end portion, said short-circuit end portions of the inner conductor of said dielectric resonator of the second kind each magnetically coupling with the short-circuit end portion of the inner conductor of one of said two dielectric resonators of the first kind through the opening thereof.

30. The dielectric resonator apparatus of claim 29 wherein at least one signal input-output terminal is formed on an opposite side surface of one of said dielectric resonators of the first kind, said signal input-output terminal being separated from the outer conductor, said opposite side surface being parallel to the surface across which said dielectric resonators of the first and second kinds are attached to each other.

* * * * *